US008365572B2

(12) United States Patent
Benini

(10) Patent No.: US 8,365,572 B2
(45) Date of Patent: Feb. 5, 2013

(54) METHOD AND DEVICE FOR MANUFACTURING BIMETALLIC PIPES

(75) Inventor: Silvano Benini, Cesena (IT)

(73) Assignee: BE. TUBE S.R.L. (IT)

( * ) Notice: Subject to any disclaimer, the term of this patent is extended or adjusted under 35 U.S.C. 154(b) by 0 days.

(21) Appl. No.: 13/428,834

(22) Filed: Mar. 23, 2012

(65) Prior Publication Data

US 2012/0180541 A1 Jul. 19, 2012

Related U.S. Application Data

(62) Division of application No. 12/866,753, filed as application No. PCT/IB2009/050878 on Mar. 4, 2009, now Pat. No. 8,220,302.

(30) Foreign Application Priority Data

Mar. 5, 2008 (IT) ..... RA2008A0010

(51) Int. Cl.
*B21D 26/02* (2011.01)

(52) U.S. Cl. ..... 72/370.22

(58) Field of Classification Search ..... 72/61, 62, 72/56, 58, 370.22; 29/421.1
See application file for complete search history.

(56) References Cited

U.S. PATENT DOCUMENTS

| | | | | |
|---|---|---|---|---|
| 3,030,901 | A | 4/1962 | McConnell | |
| 8,220,302 | B2 * | 7/2012 | Benini | 72/61 |

FOREIGN PATENT DOCUMENTS

| | | | |
|---|---|---|---|
| DE | 4406726 | A1 | 9/1995 |
| JP | 57154336 | A | 9/1982 |
| JP | 57154337 | A | 9/1982 |
| JP | 60049818 | A | 3/1985 |

* cited by examiner

*Primary Examiner* — Faye Francis
(74) *Attorney, Agent, or Firm* — Ziolkowski Patent Solutions Group, SC

(57) ABSTRACT

The means for making a bimetallic pipe, made up of a pipe telescopically inserted with clearance inside a pipe and projecting from both ends of the latter, comprising a fixed expansion head and a moveable expansion head, wherein the ends of the bimetallic pipe are inserted before proceeding to the hydraulic or oil hydraulic closure of particular clamping members around each end of the outer pipe while the inner pipe has the ends positioned against the corresponding elastic abutments made inside each of the above-mentioned heads, thus being free to move axially and radially to rotate around its own axis during plastic expansion thereof.

7 Claims, 3 Drawing Sheets

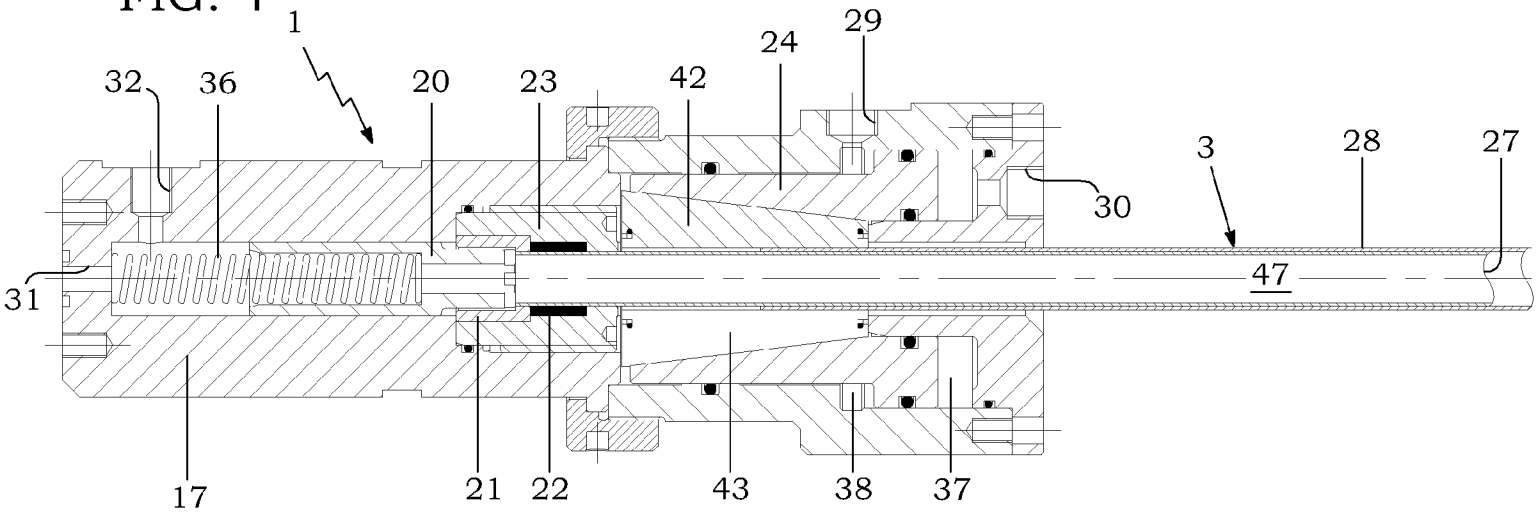
FIG. 4
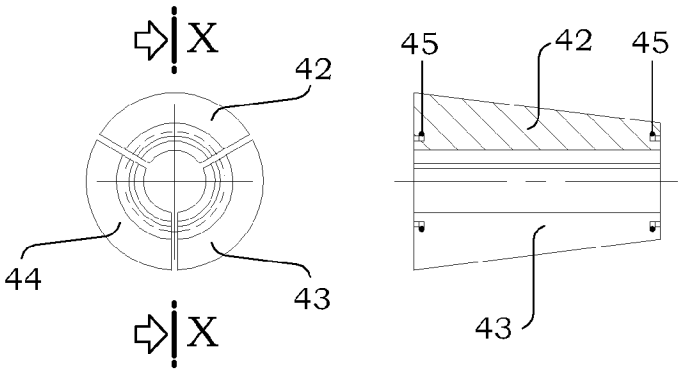
FIG. 5
FIG. 6

METHOD AND DEVICE FOR MANUFACTURING BIMETALLIC PIPES

CROSS REFERENCE TO RELATED APPLICATIONS

The present application is a divisional of and claims priority to U.S. Ser. No. 12/866,753 filed Aug. 9, 2010, which is a National Stage application of and claims priority to PCT Application PCT/IB2009/050878, filed on Mar. 4, 2009, which claims priority to Italian Patent Application RA2008A000010, filed on Mar. 5, 2008, the disclosures of which are incorporated herein by reference.

TECHNICAL FIELD

The present finding regards a method and the means required for making bimetallic pipes.

BACKGROUND OF THE INVENTION

As known, bimetallic pipes are made up of two pipes of different material attached to each other telescopically by means of particular methods of manufacture which, though deferring in the process, are all intended to attain a product similar to a single pipe as the final result.

The fields of use of bimetallic pipes vary widely and, in particular, there are numerous sectors in which operations leading to high outer stresses alongside a high risk of corrosion of the pipes due to direct contact with corrosive and potentially hazardous fluids such as the ones used, for example, in the chemical, petrochemical, fertilisers, thermal power stations and nuclear plants, etc., are performed.

Consequently, the pipe to be attached must have complementary characteristics given that the outer one, preferably made of steel or its alloys, must resist against particularly heavy loads while the inner one, preferably made of copper, aluminium, titanium, zirconium or their alloys, etc., must allow contact with corrosive fluids and/or fluids under high operation pressure.

In order to obtain a perfect attaching of the two pipes inserted one into the other it is indispensable that the coupling process used, alongside avoiding the formation of oxygen or the like between the contact surfaces, there be guaranteed resistance against detachment by traction as well as duration of the coupling over time.

BRIEF DESCRIPTION OF THE INVENTION

Object of the present invention finding is that of providing a method and the means required to process bimetallic pipes in a quick and inexpensive manner by means of hydraulic expansion of the inner pipe which, free to move axially and radially and rotate around its own axis, is deformed plastically while the outer pipe is maintained immobile at the ends during the entire expansion process at the end of which it results undeformed.

BRIEF DESCRIPTION OF THE DRAWINGS

Said means are described hereinafter with reference to three drawings wherein provided strictly for indicative and non-limiting purposes are:

FIG. 4 which shows, through a longitudinal section, the end of the pipe to be made clamped inside the fixed head.

FIGS. 5 and 6 which show, respectively, the front view and the section X-X related thereto, of the vice for clamping the end of the pipe to be made.

DETAILED DESCRIPTION OF THE PREFERRED EMBODIMENT

Figure 1:
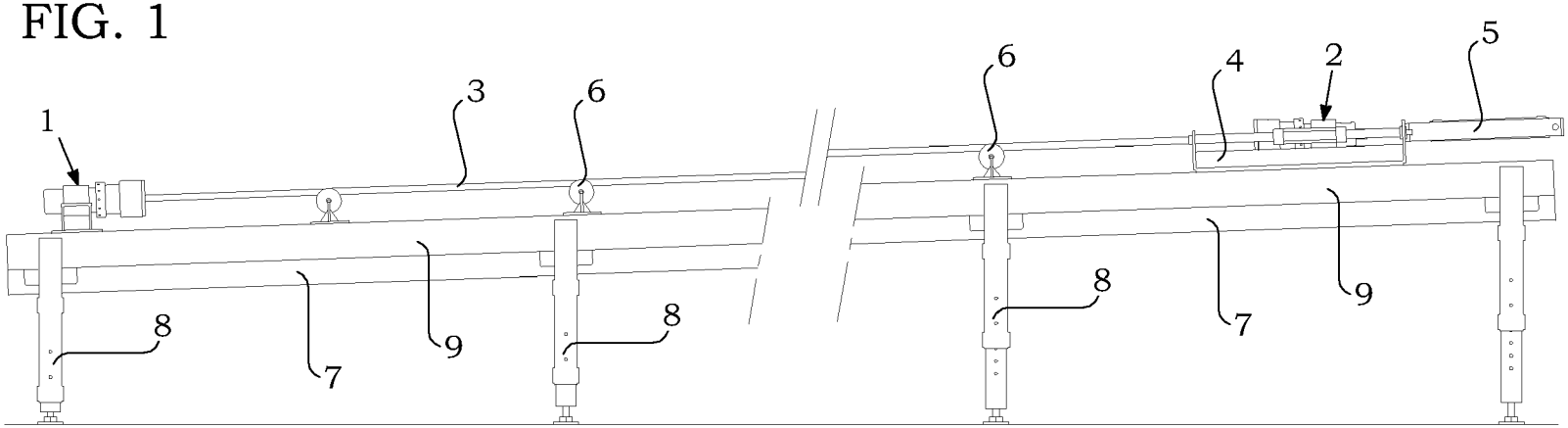
FIG. 1 which shows, with an interrupted elevation view, a pipe to be made held on a special framework and with the ends arranged inside two clamping heads one of which is moveable and the other fixed.

By observing the attached drawings and starting from the ones of FIG. 1 it is deducible that a metal framework 6-8-9 supports a fixed head 1 and a moveable head 2 clamped on which is the pipe to be made 3 and further supports all the auxiliary components 4-5-7 indispensable to make the making the abovementioned pipe 3.

Figure 2:
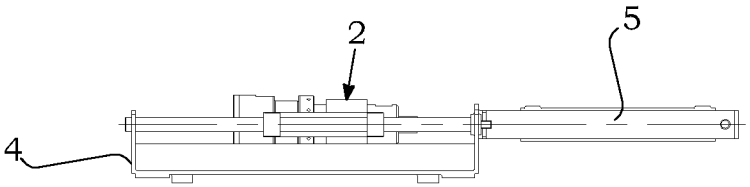
FIGS. 2 and 3 which show a side view and a top view of the moveable head installed on a sliding track thereof.
Figure 3:
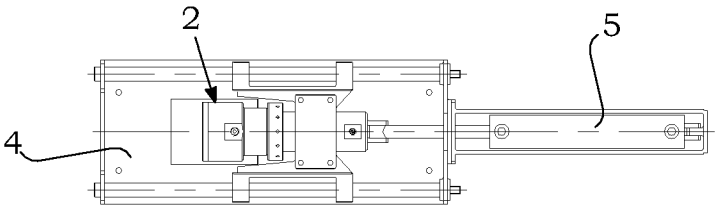

In particular, the moveable head 2 slides on a sort of track 4 (FIGS. 2 and 3) actuated by a piston 5, hydraulic or oil hydraulic, to attain the exact work position regarding the length of the pipe 3. Said track 4 is integral with a lane 9 which—bearing the supports 6 on which the pipe to be made 3 is slidingly laid at the upper part—is supported by a plurality of legs 8 adjustable in height in order to position said pipe with a slight slope to facilitate, at the right time, both the discharge of air from inside the pipe and the discharge of the process fluid to be recovered in an underlying vat 7.

The pipe to be made 3, made up of a pipe 27 telescopically inserted with clearance inside a pipe 28 as well as projecting from both ends of the latter, is arranged on the support framework 6-8-9 positioning an end of the inner pipe 27 in abutment inside the moveable head 2, maintained at a completely recessed position by the piston 5 at the end of the stroke, while the other end is aligned with respect to the fixed head 1 to be inserted therein, up to the special abutment provided for, by means of the forward motion of the moveable head 2 pushed by the stem of the piston 5 connected thereto in the element 35.

Figure 7:
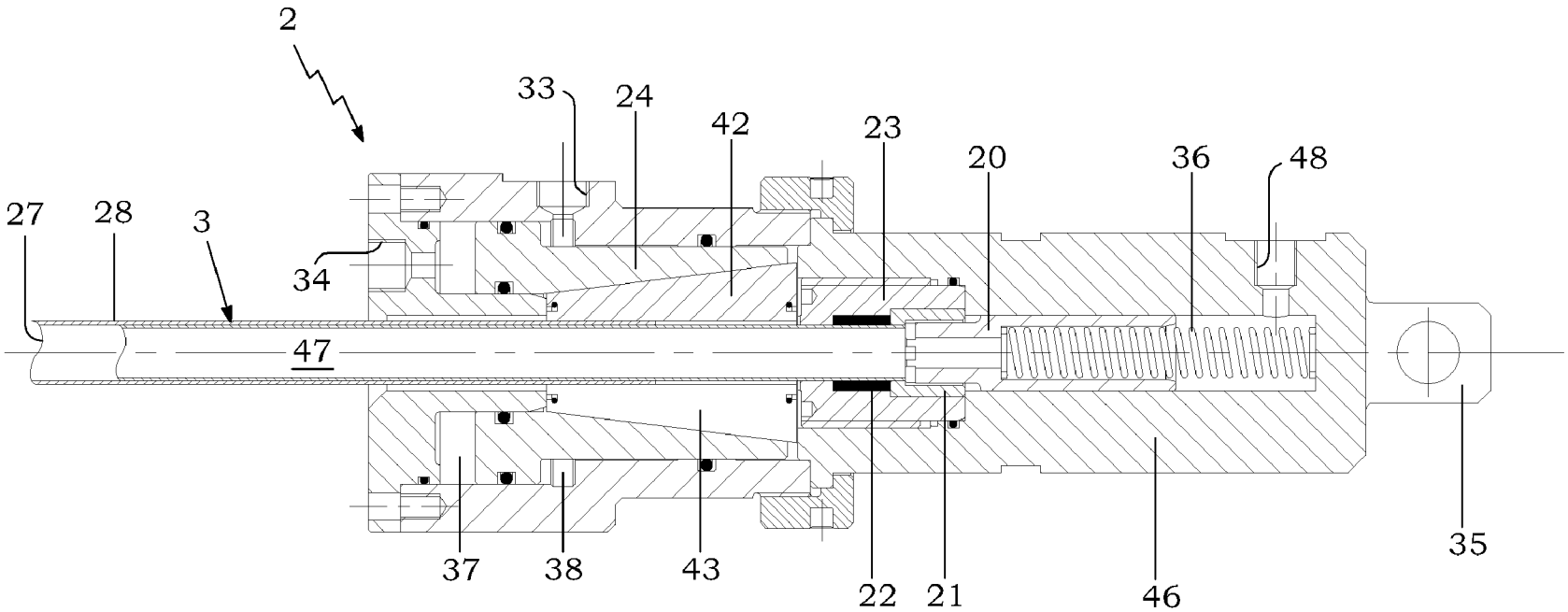
FIG. 7 which shows, through a longitudinal section, the end of the pipe to be made clamped inside the moveable head.

As observable from FIGS. 4 and 7, each of the ends of the inner pipe 27 lies, both inside the fixed head 1 and inside the moveable head 2, against the end of an almost cylindrical element 20 coupled to a helical torsion spring 36 countering the forward motion imparted by the abovementioned piston 5 in such a manner to prevent the flexure and damaging of the pipe 3 when positioning it in the heads 1 and 2. As a matter of fact, said forward motion continues until equilibrium is attained between the elastic force developed by the springs 36 and the hydraulic force developed by the piston 5 and regulated by a special valve of the known type.

The two elements 20 and the respective helical torsion springs 36 provide for the axial arrangement of the pipe 27 to be subjected to pressure. The sealing device comprises special gaskets 22 and a centring bushing 21 inserted coaxially inside a threaded sleeve 23 inside which each end of the inner pipe 27 is abutted against the element 20 and compressed therein by means of the spring 36 respectively accommodated inside the body 17 of the fixed head 1 and inside the body 46 of the moveable head 2.

Once the ends of the inner pipe 27 are arranged inside the heads 1 and 2, next follows the oil hydraulic closure, around each end of the outer pipe 28, of particular clamping vices 42-43-44 (FIGS. 5 and 6), and obtained by means of a cone sectioned at 120° and accommodated in a piston 24, also conical and actuated oil-hydraulically due to two pressurization chambers 37 and 38 into which a liquid under pressure is introduced respectively through the openings 29 and 30 of head 1 and the openings 33 and 34 of head 2, in such a manner to move the piston 24 in a parallel to the axis of the pipe 27 and 28 and, hence, close or open the vices 42-43-44, always maintained at contact with the internal of the piston 24 due to a pair of single ring springs 45.

Said clamping, maintained up to the end of the hydraulic expansion process, exclusively regards the outer pipe 28 whose dimensions are not modified during the expansion, contrary to the inner pipe 27 which, free to move axially and radially and rotate around its own axis, expands freely hence shortening longitudinally and widening radially.

After having positioned and clamped the pipe 3 in the described manner inside the heads 1 and 2, there follows the filling of the volume 47 of the pipe 3 with a fluid (usually emulsified, demineralised or common water) introduced through a valve of the known type actuated manually or automatically and connected to the coupling 31 of the fixed head 1. Said filling is performed up to the exit of the fluid from a special discharge valve connected to the coupling 48 of the moveable head 2 and, at this point, said valves are closed after verifying the complete exit of the air from inside the pipe to be made, such exit being facilitated by the slight slope of the support framework.

The expansion occurs by adding water at high pressure into the volume 47 and maintaining it, using a pressure multiplier of the known type, for a period of time comprised between 5 and 100 seconds.

Once attained the maximum operating pressure of the introduced fluid, verified by a manometer connected to the coupling 32 of the fixed head 1 and exceeded which there would be an unwanted plastic deformation of the outer pipe 28, the expansion is terminated and, then the pressure multiplier is stopped and the special discharge valves are opened to remove the internal fluid through the outlet 48 of the moveable head 2.

The opening of the vices 42-43-44 of both heads 1 and 2 and the moving away from the fixed head 1 of the moveable head 2 actuated by the hydraulic piston 5 allow removing the bimetal pipe 3 thus made to deposit it in the special storage area.

According to the points argued above it is deducible that the short duration of the expansion does not lead to an increase of the temperature of the pipe to be made and, hence, there is no need to wait for the pipe to reach thermal stability before removing said expansion pressure.

In a possible variant embodiment the inner pipe 27 could be abutted against a special seat provided for inside the member 20, possibly interposing a gasket which replaces the outer sealing member 22 thereof.

The method herein for making bimetallic pipes is characterised in that it comprises the following steps:

1. positioning an end of the inner pipe 27 in abutment inside the moveable expansion head 2 maintaining the other end at a distance from the fixed head 1 sufficient to perform the attachment (indicatively 100 mm);

2. moving the moveable head 2 forward by moving the hydraulic piston 5 controlled by a special valve and, simultaneously, guiding the free end of the pipe to be made inside the fixed head 1 up to the contact of the inner pipe 27 with the abutment provided thereof and, precisely, up to obtaining equilibrium between the elastic force of the springs 36 and the hydraulic force applied by the piston 5;

3. proceeding to clamp the outer pipe 28 by means of hydraulic closure of the vices 42-43-44 present inside the fixed head 1 and inside the moveable head 2;

4. filling the pipe to be made with suitable fluid introduced through the inlet 31 of the fixed head 1 and up to its exit from the opening 48 of the moveable head 2;

5. isolating the volume inside the pipe to be made by closing the outlet 48 and the inlet valve of the known type connected to the vat of the fluid to be inserted into the pipe and ensuring that all the air therein is removed;

6. actuating the pressure multiplier by means of a special hydraulic power unit and compressing the fluid volume contained inside the pipe to be made;

7. increasing the pressure up to reaching the operating pressure and maintaining it for the preset period of time (from 5 to 100 seconds);

8. blocking each source of pressure and supply;

9. discharging the water under pressure through the outlet 48;

10. freeing the pipe from the clamping and sealing system and pouring the residual water.

In conclusion, it is obvious that the means represented and described may be subjected to modifications and variants which, falling within the scope of protection of the present patent application in any case, could for example concern the replacement of the clamping vices 42-43-44 with other equivalent securing elements.

What is claimed is:

1. Method for manufacturing bimetallic pipes starting from an outer pipe and an inner pipe telescopically inserted with clearance inside the outer pipe, characterised in that it comprises the following steps:

providing a movable head and a fixed head, internally provided with clamping members suitable for the attachment with a respective end of the pipes, the fixed head being provided with an inlet for the supply of a suitable fluid from a respective vat and the movable head being provided with an outlet for the discharge of the fluid;

providing an elastic abutment inside both the movable head and the fixed head, for the positioning of the ends of the pipes;

providing a hydraulic piston controlled by a valve for setting the movable head in motion;

moving the moveable head forward by means of the piston and, simultaneously, guiding the free end of the pipe to be made inside the fixed head up to the contact of the inner pipe with the respective abutment up to obtaining equilibrium between the elastic force exerted by the elastic abutment and the hydraulic force applied by the piston, in order to avoid damaging or bending the pipe to be made;

clamping the outer pipe by means of hydraulic closure of the clamping members present inside the fixed head and inside the moveable head; and compressing the fluid volume isolated inside the pipe to be made, by means of a pressure multiplier.

2. Method according to claim 1, characterized in that the preset period of time for which the operating pressure is maintained inside the pipe to be made is comprised between 5 and 100 seconds.

3. Method according to claim 1, characterized in that it further comprises the step of positioning the end of the inner pipe in abutment inside the moveable head and maintaining the other end at a distance from the fixed head that is sufficient to introduce the pipes between the heads.

4. Method according to claim 1, characterized in that it further comprises the step of filling the pipe to be made with the fluid introduced through the inlet of the fixed head and up to the exit of the fluid from the outlet of the moveable head.

5. Method according to claim 1, characterized in that it further comprises the step of isolating the volume inside the pipe to be made by closing the outlet and the inlet connected to the vat of the fluid to be inserted into the pipe and ensuring that all the air present therein is removed.

6. Method according to claim 1, characterized in that it further comprises the steps of:

increasing the pressure up to reaching an operating pressure and maintaining it for a preset period of time;

stopping each source of pressure and supply; and discharging the fluid under pressure through the outlet.

7. Method according to claim 1, characterized in that it further comprises the step of freeing the pipe from the clamping and sealing system and pouring the residual fluid.

* * * * *